United States Patent [19]

Strobl

[11] 4,095,383

[45] Jun. 20, 1978

[54] ROOF-SHEETING ELEMENT WITH INTEGRAL LATH STRUCTURE

[75] Inventor: Horst Strobl, Grunwald, Germany

[73] Assignee: Neumann & Co. AG, Buchs, Switzerland

[21] Appl. No.: 708,019

[22] Filed: Jul. 23, 1976

[30] Foreign Application Priority Data

Jul. 23, 1975 Germany ..... 2532853

[51] Int. Cl.[2] ..... E04C 1/12

[52] U.S. Cl. ..... 52/309.7; 52/313; 52/309.9; 52/550; 52/539; 52/732

[58] Field of Search ..... 52/309.7, 539, 555, 52/518–520, 313, 540, 309.16, 592, 550, 309.4, 309.2, 309.9; 428/313–315

[56] References Cited

U.S. PATENT DOCUMENTS

| | | | |
|---|---|---|---|
| 271,308 | 1/1883 | Bronnum | 52/539 |
| 3,138,834 | 6/1964 | Shanok et al. | 52/716 |
| 3,470,598 | 10/1969 | Berthelsen | 52/309.16 |
| 3,506,533 | 4/1970 | Berner | 428/314 |
| 3,789,556 | 2/1974 | Skinner | 52/539 |
| 3,852,934 | 12/1974 | Kirkhuff | 52/555 |
| 3,899,855 | 8/1975 | Gadsby | 52/520 |

FOREIGN PATENT DOCUMENTS

| | | | |
|---|---|---|---|
| 8,587 | 2/1908 | France | 52/550 |
| 894,755 | 10/1953 | Germany | 52/540 |
| 548,154 | 9/1942 | United Kingdom | 52/518 |
| 1,181,895 | 2/1970 | United Kingdom | 428/314 |
| 1,112,081 | 5/1968 | United Kingdom | 428/314 |
| 1,309,040 | 3/1973 | United Kingdom | 52/313 |

*Primary Examiner*—James L. Ridgill, Jr.
*Attorney, Agent, or Firm*—Larson, Taylor and Hinds

[57] ABSTRACT

This invention relates to a roof-sheeting element with an integral lath structure consisting mainly of a board-like basic member and a lath-like attachment which is solidly joined to the basic member, projects from one of its longitudinal sides and extends over its entire length.

6 Claims, 4 Drawing Figures

ROOF-SHEETING ELEMENT WITH INTEGRAL LATH STRUCTURE

The present invention relates to a roof-sheeting element with an integral lath structure for tiled roofs.

In normal roof-covering systems with roof tiles, the sheeting boards are first nailed on to the rafters, on which webs of roofing felt or plastics film are then laid to provide a seal against dust, moisture and snow carried in by the wind. To prevent the laths, which are fitted later, from bearing directly on the roofing felt or the plastics film — a situation that would soon cause the laths to begin to rot in damp conditions — a latticing structure is then fitted and, finally, the laths themselves. Thereafter the roof tiles are placed on the laths.

The disadvantages associated with such a construction are obvious. They are caused in particular by the four different time-consuming operations which, furthermore, should only be carried out in dry weather before the tiles can be applied. In the case of roofs having aprons, the projecting parts are constructed with planed commercially-available boards whicha are usually thinner, so that additional levelling is necessary. A further serious disadvantage of this structure is in particular the absence of heat-insulation and cold-insulation means which still have to be added, so that a further operation is necessary.

The object of the present invention is therefore to provide a roof-sheeting element for tiled roofs which can be applied to the roof in a single operation and which also replaces the usual wooden sheeting, roofing felt or plastics film, latticing, laths and, in addition, also the thermal insulation means.

According to the invention, this object is achieved by a roof-sheeting element which including a board-like basic member and a lath-like attachment which is solidly joined to the basic member, projects from one of its longitudinal sides, and extends over its entire length, of foamed plastic in sandwich structure, with a sectional reinforcing element let into the lath-like attachment for the purpose of reinforcing an edge of the lath-like attachment, which element is angled, perforated, and extends into the basic element and over the entire length of the roof-sheeting element.

It will be clearly seen from the roof-sheeting element of the invention, illustrated in cross-section in FIG. 1, that a novel component has been created which meets practical requirements and can be as easily fitted as the known sheeting system using boards; in other words, fitting of this novel component equates with the first operation used in the existing system.

The distance between laths, which can vary by a few centimeteres depending upon the size of the tiles and upon the length of the rafters, can be easily achieved by cutting the basic member to the required width along that of its sides remote from the attachment.

A further considerable advantage provided by the invention resides in the fact that the great heat-insulation provided by this sheeting greatly reduces or completely eliminates the progressively increasing build-up of ice on the roofs. The build-up of ice, which causes considerable damage to buildings every year, mainly occurs because, as a result of the poor insulation of lofts, snow melts on the roof and immediately leads to the formation of ice on the cold apron, so that further flow of water into the gutters is impeded and ice builds up and extends rearwardly and forces itself under the tiles. This effect is inhibited if the insulation is satisfactory.

The attachement 2 not only performs the function of a lath, but also functions as an overlapping portion whereby a waterproof complete roof-sheeting system is achieved without interfering with the possibility of allowing vapor to escape at the zones concerned.

The roof-sheeting elements in accordance with the invention are particularly suitable for the sheeting of inclined roof structures such as those of saddle, hip and single-pitch roofs. If required, their surfaces, which are visible after the inner structure of the building has been erected, can be provided with a special texturing or profiling and/or coloring, or wood-graining.

The roof-sheeting element in accordance with the invention can be produced from any material suitable for the purposes of the invention, and the basic element may even be made of a different material from that of the lath-shaped attachment. Preferably, however, the roof-sheeting element in accordance with the invention is made of one material and is produced virtually as a one-piece component or as a single molding. Suitable materials of which the roof-sheeting elements of the invention can be made include, for example, expanded platics, particularly hard expanded polyurethane, the materials used for producing boards commercially available under the trade-name Heraklit, and expanded concrete, as well as suitably prepared weather-resisting chipboards.

The roof-sheeting element of the invention also has a sectional reinforcing element 4 let into the lath-like attachment 2 so as to strengthen the edge 3 of the said attachment, which reinforcing element is angular, or is solid or hollow of, rectangular cross-section, and extends over the entire length of the lath-like attachment.

The surfaces of the element are provided with additional coverings or sheet-metal facings. Accordingly, the roof-sheeting elements of the invention may consist of a sheet-metal sectional element, for example of aluminum, and of a suitable insert, for example a Styropor insert secured in the sectional element by an adhesive.

The roof-sheeting elements of the invention are therefore of sandwich construction (also known as a light core composite structure). Sandwich constructions is the name given to sectional elements, boards or three-dimensional members consisting of strong, preferably thin or very thin, covering layers which are solidly joined to a core layer of low specific weight and are supported thereby over a large area. The ability of the core of light material to support the covering layers is dependent upon its weight per unit volume and upon its bond with the covering layers. The cores of light material, are made of plastic foam materials, particularly hard polyurethane foam, which can be produced in a very wide variety of weights per unit volume. The hard expanded polyurethanes, particularly those based on polyisocyanurate (expanded PIR), are therefore preferably used for the sheeting elements of the invention. These expanded plastics materials preferably contain flameproofing additives, or use is made of such initial materials having a flame-inhibiting or flameproofing effect. Furthermore, these expanded plastics materials may contain considerable quantities of fillers, which may be based on finely divided mineral materials or in the form of wood-dust, so that compressive strength, for example, can be incresed. It is also possible to use systems wherein, during the forming of the polymer, different reactions occur in parallel, for example the formation of polyurethane and the formation of polyester, the two systems being simultaneously linked by the unsaturated polyesters which participate in the two reactions and contain resultant OH groups. The method of producing these products, particularly the expanded hard polyurethanes are well known to the expert in the field. For example, reference may be made to Kunstoffbuch, volume VII, Polyurethane, by Vieweg/Hochtlen (Karl Hanser-Verlag, Munich, 1966), in connection with the production of hard expanded polyurethanes.

The covering layers used for producing such sandwich constructions can likewise consist of any required material and can likewise be suitably profiled or left smooth to suit particular tastes. The covering layers may, of course, be decorated in other ways; for example a wood-like appearance can be imparted to them.

The sandwich constructions can be produced on an intermittent or continuous basis, and for this purpose it is possible to use both the bonding method (also known as the "layup method" or the "sheathing process") and the foam-in-situ method (also called the "filling process"). According to the invention, preference is given to the foam-in-situ method, since it enables the core of expanded plastics material to be formed in a manner very well suited to the material.

According to the invention, such roof-sheeting elements are particularly preferred that are made of hard expanded polyurethane and which have an outer coating, preferably one made of "silver paper" ie. an aluminum foil lined with paper.

The invention will now be described in greater detail by reference to FIGS. 1 and 2, to which, however, the invention is not limited. A list of the reference numerals used in the drawings will be found at the end of the description.

Figure 1:
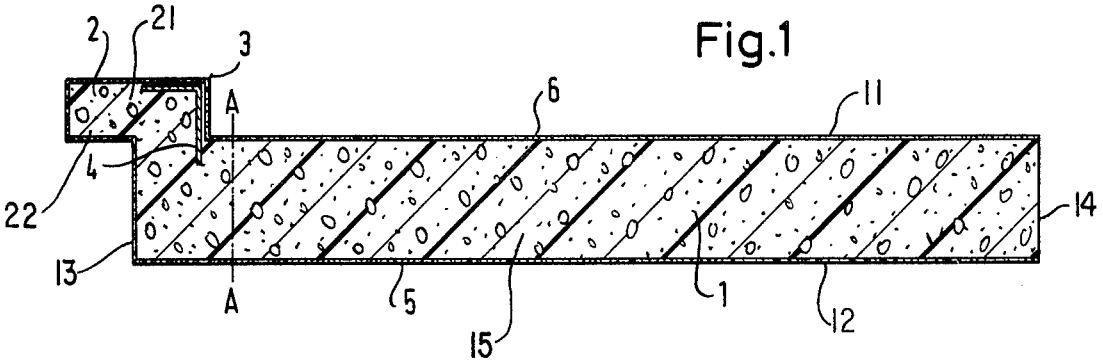
FIG. 1 shows a cross-section through the roof-sheeting element in accordance with the invention.
Figure 2:
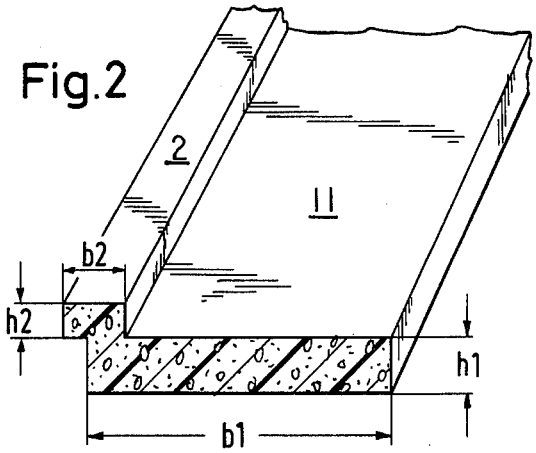
FIG. 2 is a diagrammatic perspective illustration of the roof-sheeting element of the invention.
Figure 4:
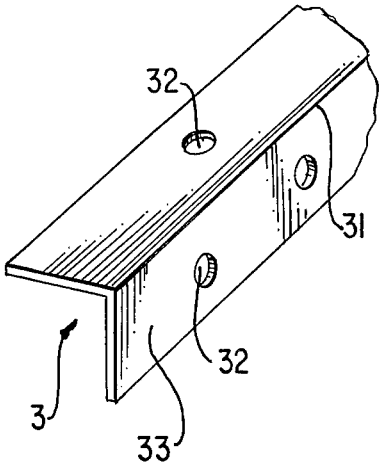
FIG. 4 is a diagrammatic perspective view of a portion of the perforated reinforcing member in the roof-sheeting element of FIG. 1.
Figure 3:
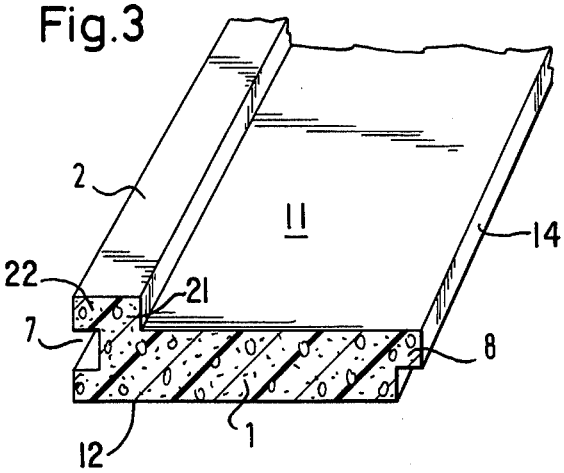
FIG. 3 is a diagrammatic perspective illustration of a further form of construction of the roof-sheeting element of the invention wherein the groove 7 is so formed that the tongue 8 of an element mated therewith fits exactly in the groove.

Elongate roof sheeting elements in accordance with the invention are shown in FIGS. 1—3. The element has a board-like member 1 having an upper surface 11 which, in use, is to be positioned uppermost adjacent the lower surface of roof tiles to be supported thereby. The element also has a lower surface 12 which, in use, is to be positioned lowermost to be supported by an inclined roof structure. A lath-like member 2 integral with the board-like member 1 extends along the entire length of only one side, side 13, of the two longitudinal sides 13 and 14 of board member 1. Lath-like member 2 has a first portion 21 extending upwardly from upper surface 11 of board-like member 1 along its entire length and a second portion 22 projecting outwardly beyond side 13 only along its entire length. It will be readily apparent that, when two of the roof-sheeting elements are located with longitudinal side 13 of a first element adjacent longitudinal side 14 of a second element, second portion 22 of lath-like member 2 extends over the upper surface 11 of the second element adjacent side 14 of the second element thereby covering the joint formed between longitudinal side 13 of the first element and longitudinal side 14 of the second element. In the illustrated embodiments, the board-like member 1 and the lath-like member 2 are integral and have a light core composite structure including an expanded plastic core 15 and an outer layer 5.6 of a covering material bonded to the expanded plastic core. An elongate reinforcement element 3 is embedded in the expanded plastic core and disposed lengthwise in lath-like member 2 along the entire length thereof. The reinforcing element is angled to form edge 31 and perforated at 32 and has a longitudinal marginal portion 33 extending into the expanded plastic core of board-like member 1 along the entire length thereof.

The roof-sheeting elements of the invention, illustrated in FIGS. 1, 2 and 3, preferably consist of a hard expanded polyurethane having a weight per unit volume of approximately 50 kg/m$^3$, and they preferably have a stable jacketing of aluminum foil (having a thickness of 0.03 mm) coated with paper (80 g/m$^2$). To strengthen the edge 3, a sheet-metal angle element 4, obtainable in the building industry under the name "corner flashing" is let into the lath-like attachment 2. In the continuous production of the roof-sheeting element of the invention, it may be advantageous to use perforated sheet-metal angle elements which are only angled just before they are fed into the mold channel. Wooden laths, which are incorporated during expanding in a suitable manner, may, of course, also be used as reinforcing material.

The roof-sheeting elements in accordance with the invention may, of course, also be produced by first forming the basic member 1 and then providing this with the lath-like attachment 2, likewise produced separately, the member 1 and the attachment being glued together for example. The lath-like attachment 2 may be made of the same material as the basic member 1, or it may be of a different material.

In the continuous production of the roof-sheeting element in accordance with the invention, two different foam mixtures can be brought into the mold channel simultaneaously, so that the expanded material on that side of the sheeting element carrying the lath-like attachment 2, is denser and stronger than in the zone to the right of the broken line A—A seen in FIG. 1.

The roof-sheeting elements made of hard expanded polyurethane as proposed by the invention are not only preferred because of the advantages of the method whereby they are produced, but also, in particular, because they provide the best thermal insulation while possessing adequate stability since they are sandwich elements. When "silver paper" is used, there accrues the further advantage that the aluminum foil, located on the outside, radiates the heat back.

The length of the roof-sheeting elements may be as required, and is preferably 3 to 5 meters. The thickness $h_1$, indicated in FIG. 2, is preferably 40 mm, and the thickness $h_2$, preferably 20 mm. The width $b_1$, likewise indicated in FIG. 2, is preferably 290 to 340 mm, and the width $b_2$, preferably 40 mm.

List of reference numerals

1; basic member
2; lath-like attachment
3; edge of lath-like attachment 2
4; sectional reinforcing element
5; outer layer of sandwich element
6; outer layer of sandwich element 7; groove
8; tongue.

What I claim is:

1. An elongate roof-sheeting element with an integral lath structure for supporting roof tiles on an inclined roof structure comprising:

a board-like member having an upper surface to be positioned adjacent the lower surface of roof tiles to be supported thereby and having a lower surface to be supported by an inclined roof structure;

a lath-like member integral with said board-like member and extending along the entire length of one only of the longitudinal sides of said board member, said lath-like member having a first portion extending upwardly from the upper surface of said board-like member along its entire length and having a second portion projecting outwardly from said first portion beyond said one longitudinal side only of said board-like member along its entire length, said lath-like member being constructed and arranged such that when two of said elongate roof-sheeting elements are located with said one longitudinal side of a first roof-sheeting element adjacent the longitudinal side of a second roof sheeting element remote from said one longitudinal side of said second roof sheeting element, said second portion of said lath-like member extends over the upper surface of said second roof sheeting element adjacent said remote side thereof thereby covering a joint formed between the adjacent longitudinal sides of said first and second roof sheeting elements;

said board-like member and said lath-like member being integral and having a light core composite structure comprising an expanded plastic core and a layer of a covering material bonded to said expanded plastic core; and an elongate reinforcing element embedded in said expanded plastic core and disposed lengthwise in said lath-like member along the entire length thereof, said reinforcing element being angled and perforated and having a longitudinal marginal portion extending into the expanded plastic core of said board-like member along the entire length thereof.

2. A rood-sheeting element according to claim 1 wherein said lower surface of said board-like member is textured or colored.

3. A roof-sheeting element according to claim 1 wherein said lower surface of said board-like member is textured with wood-graining.

4. A roof-sheeting element according to claim 1 wherein said expanded plastic comprises hard expanded polyurethane.

5. A roof-sheeting element according to claim 4 wherein said covering material comprises aluminum foil.

6. A roof-sheeting element according to claim 5 wherein said covering material comprises paper bonded to said aluminum foil.

* * * * *